United States Patent [19]

Carlson et al.

[11] 4,123,175

[45] Oct. 31, 1978

[54] POWDER HANDLING SYSTEM

[76] Inventors: C. Burton Carlson, 400 Country Rd., Guilford, Conn. 06437; Ernest R. Hughes, 47 Tackora Trail, Ridgefield, Conn. 06877

[21] Appl. No.: 819,549

[22] Filed: Jul. 27, 1977

[51] Int. Cl.[2] ..... B01F 15/00

[52] U.S. Cl. ..... 366/151; 366/177

[58] Field of Search ..... 366/132, 136, 151, 163, 366/177, 181, 182, 336, 337, 341, 160, 161; 222/356

[56] References Cited

U.S. PATENT DOCUMENTS

| | | | |
|---|---|---|---|
| 2,838,392 | 6/1958 | Bielawski | 366/181 |
| 3,273,864 | 9/1966 | Thomson, Jr. | 366/177 |
| 3,312,374 | 4/1967 | Whitlock | 366/161 |
| 3,583,681 | 6/1971 | Brown | 366/163 |
| 3,713,626 | 1/1973 | Weber | 366/160 |

*Primary Examiner*—Leonard D. Christian

[57] ABSTRACT

A powder handling system includes chambers for collecting mixing and loading of powder, with the collecting and loading chambers being so arranged as to empty into the mixing chamber. The collecting chamber is vacuumized, and is in valved, gas-flow communication with the loading chamber, to enable the establishment of a negative pressure in the latter during operation. This permits the introduction of a fresh charge of powder without the need to shut down the system. A vertical partition is provided to divide the mixing chamber into two compartments; by discharging powder from the collecting and loading chamber into different compartments, and by thereafter mixing the two streams, blend consistency may be ensured.

10 Claims, 4 Drawing Figures

POWDER HANDLING SYSTEM

BACKGROUND OF THE INVENTION

Powder coating techniques, of both the electrostatic and non-electrostatic types, are now extensively used in industry in connection with a wide diversity of workpieces. A persistent and virtually universal problem associated with such operations involves the effective handling of unused powder. This is especially true when coating occurs from fluidized bed or spraying operations, because there is a natural tendency for the particles of the powder, which tend to be of relatively fine mesh sizes, to drift beyond the area of coating. The results are the creation of annoyance and hazard to personnel present in the vicinity, and an increase in operating costs, due to waste of the coating material.

Accordingly, systems have been developed for controlling fugitive powder. They usually employ vacuum-operated collecting tanks, into which powder may be withdrawn from the coating area, to provide a reservoir from which recycle may be had. Some of these systems are very effective, and by-and-large are entirely satisfactory.

However, as will readily be appreciated, virgin powder must be introduced into the system to replenish that which has either been used in the coating operation, or has been depleted through unavoidable loss. Generally, it is necessary to shut down the powder recovery system to enable the fresh supply of powder to be introduced, which is both time-consuming and also inconvenient.

Furthermore, it will be appreciated that the makeup of powder taken from the coating operations will vary from that freshly supplied. This is due to the selective utilization of portions of the powder for coating, the tendency for the finer particles to escape from the system, etc. Nevertheless, if uniform coatings are to be obtained it is important that the composition of the powder be consistent throughout the period of operation. Adding a quantity of virgin powder to powder which has been recycled and collected will (if not otherwise mixed) result in distinct strata within the supply; coatings produced therewith will consequently vary.

Accordingly, it is the primary object of the present invention to provide a novel, vacuum-operated powder handling system which enables the introduction of fresh powder without curtailment or cessation of normal operations.

It is also an object of the invention to provide such a system wherein means is provided to ensure the uniformity of the blend of powder which is withdrawn therefrom.

Another object of the invention is to provide a system having the foregoing features and advantages, which is also of relatively simple and inexpensive construction, and which is efficient in operation and convenient in use.

SUMMARY OF THE DISCLOSURE

It has now been found that the foregoing and related objects of the invention are readily attained in a powder handling system comprising at least one enclosure defining therewithin collecting, loading and mixing chambers. The collecting and loading chambers are in gas-flow communication with one another, and are each in powder-flow communication with the mixing chambers. The enclosure has an inlet for admitting airborne powder into the collecting chamber, it has an outlet for the withdrawal of powder from the mixing chamber, and it has a displaceable portion therein to permit entry into the loading chamber. Valve means is provided to control gas flow between the collecting and loading chambers, and means is provided for creating a vacuum within the collecting chamber. In operation of the system, powder may be drawn into the collecting chamber and discharged from the mixing chamber; the supply thereof may be replenished during such operation by placing a fresh charge of powder within the loading chamber while the valve means is so controlled as to establish a vacuum therein.

In the preferred embodiments, the enclosure comprises three housings, with the collecting, loading and mixing chambers each being defined within a different one of them. The system will additionally include a valved conduit between the collecting chamber housing and the loading chamber housing, and it will also include a valve interposed between the collecting chamber housing and the mixing chamber housing, for controlling the flow of powder from the former to the latter. Each of the housings will generally be of hopper-like configuration, with the collecting chamber housing disposed above the mixing chamber housing, to permit the gravitational flow of powder to the latter. The system may additionally include sensors adapted to detect the amounts of powder present in each of the collecting and loading chambers. Most desirably, the loading chamber housing will include a perforated, substantially horizontally disposed platform which is adapted to support a fresh charge of powder placed therewithin. It will also desirably include access ports having hand-receiving flexible members disposed thereacross, to permit manipulation of a container of powder supported upon the platform, while maintaining the closed condition of the housing.

In particularly preferred embodiments, the mixing chamber of the system contains means for vertically dividing it into two compartments. The collecting chamber communicates with a first one of the compartments, and the loading chamber communicates with a second one thereof, with both compartments being in communication with the enclosure outlet. Generally, the compartments will communicate with one another at a location upstream of the enclosure outlet, and the dividing means will normally comprise a generally vertical partition. In such a case, it will be most beneficial for the outlet to be located adjacent the lower end of the mixing chamber, and for the partition to have a lower edge disposed above the outlet, so as to afford communication between the compartments therebelow.

DETAILED DESCRIPTION OF THE ILLUSTRATED EMBODIMENT

Figure 1:
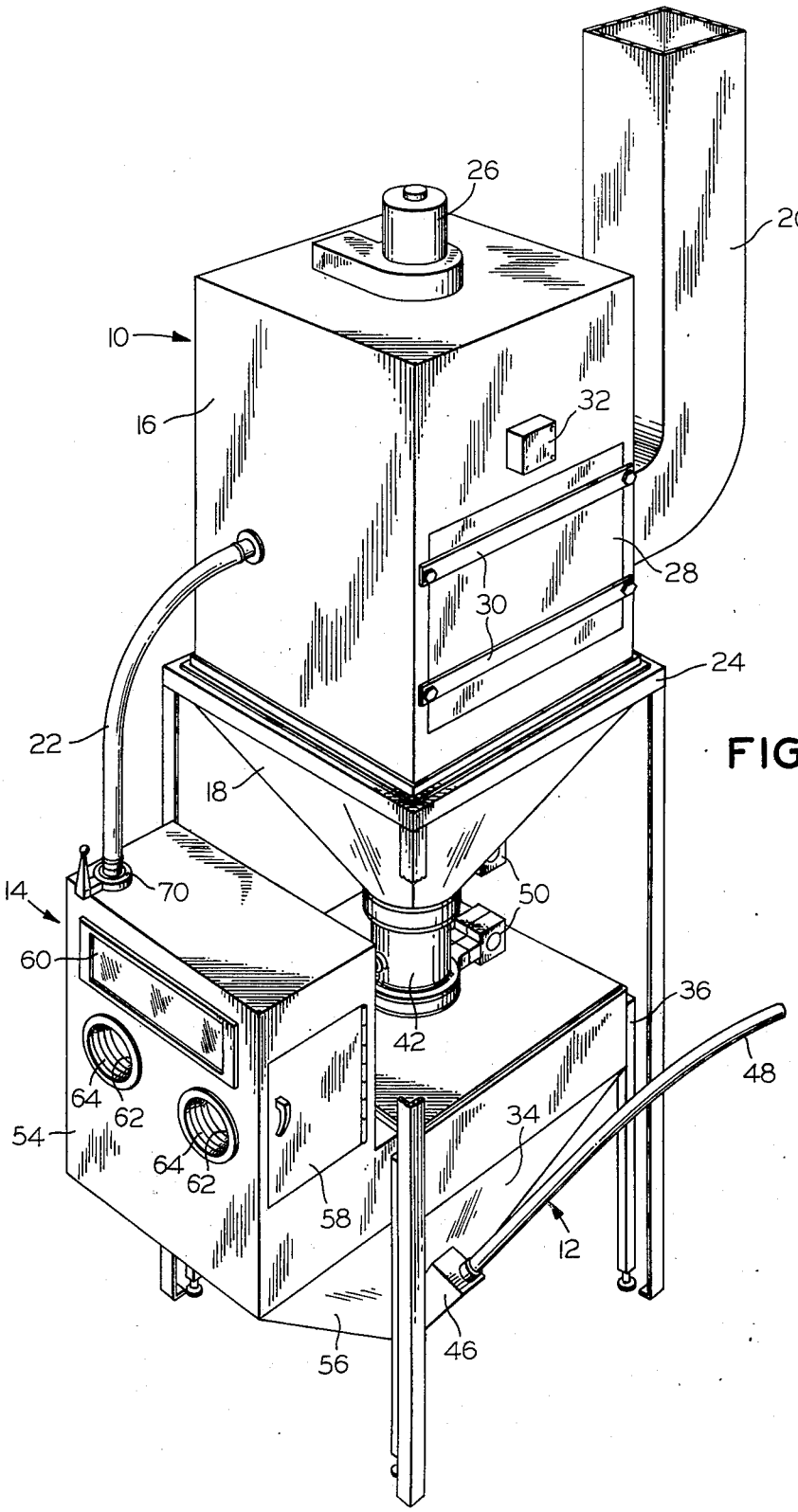
FIG. 1 is a perspective view of a system embodying the present invention.
Figure 2:
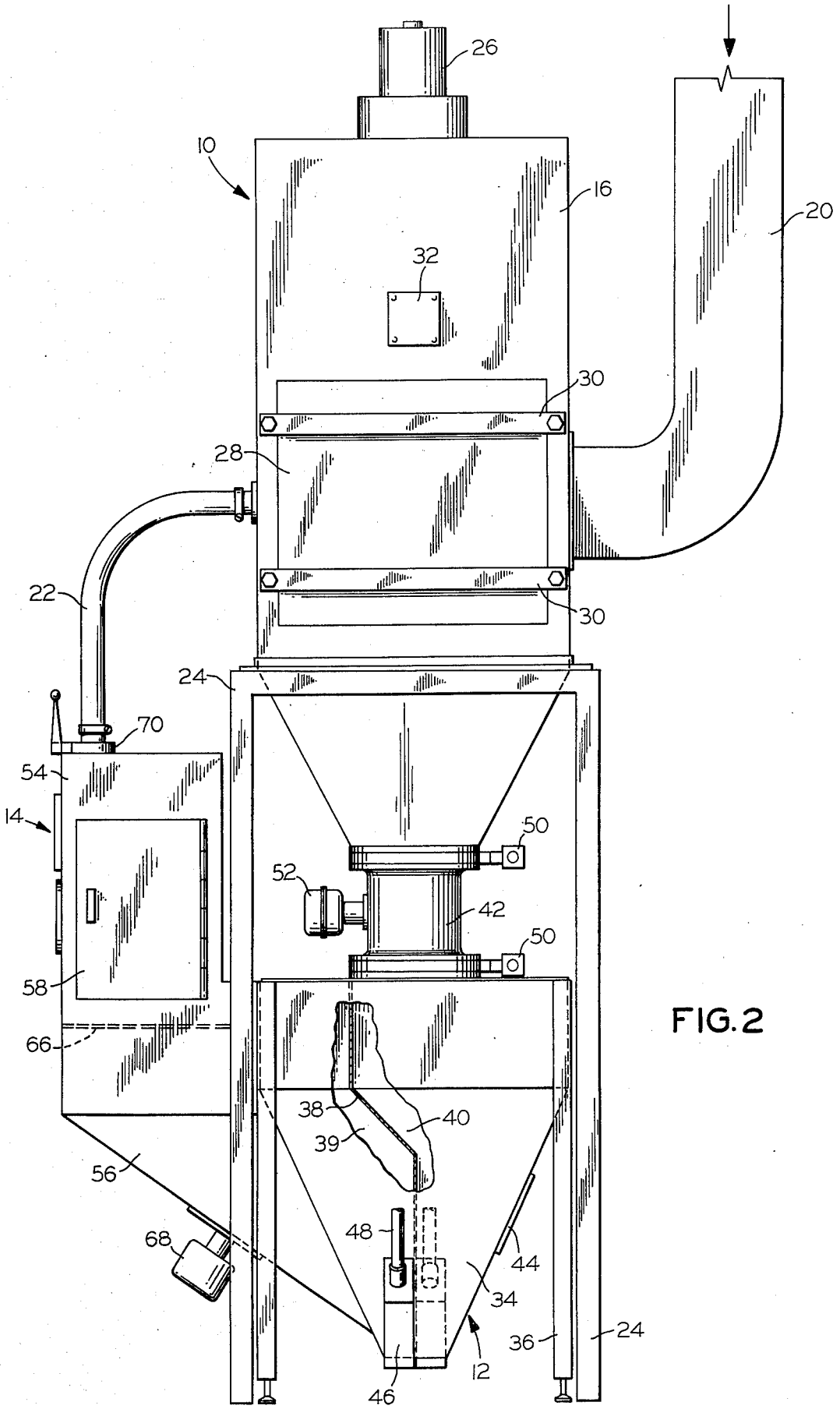
FIG. 2 is a front elevational view of the system of FIG. 1, drawn to a slightly enlarged scale and having a portion of the mixing chamber housing broken away to expose the partition provided therewithin.
Figure 4:
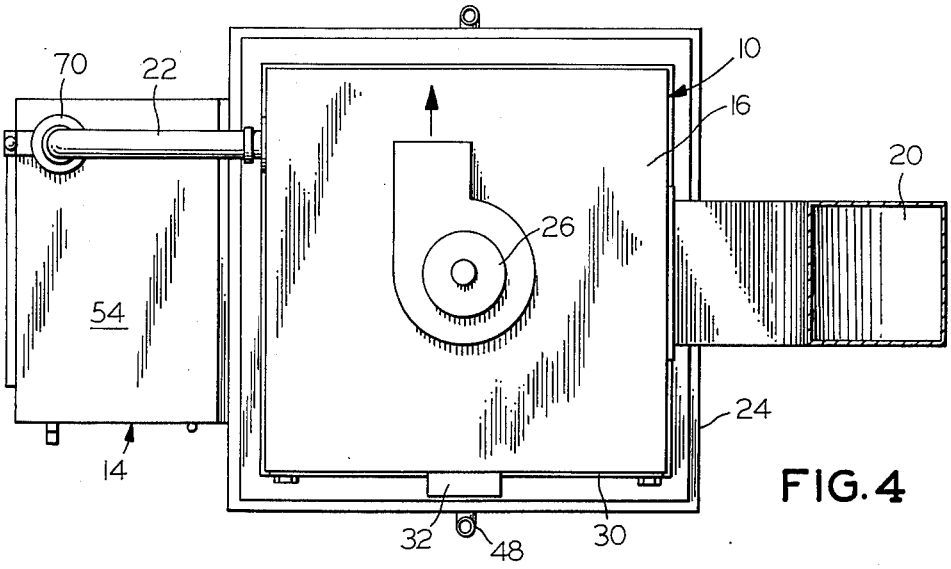
FIG. 4 is a plan view thereof.
Figure 3:
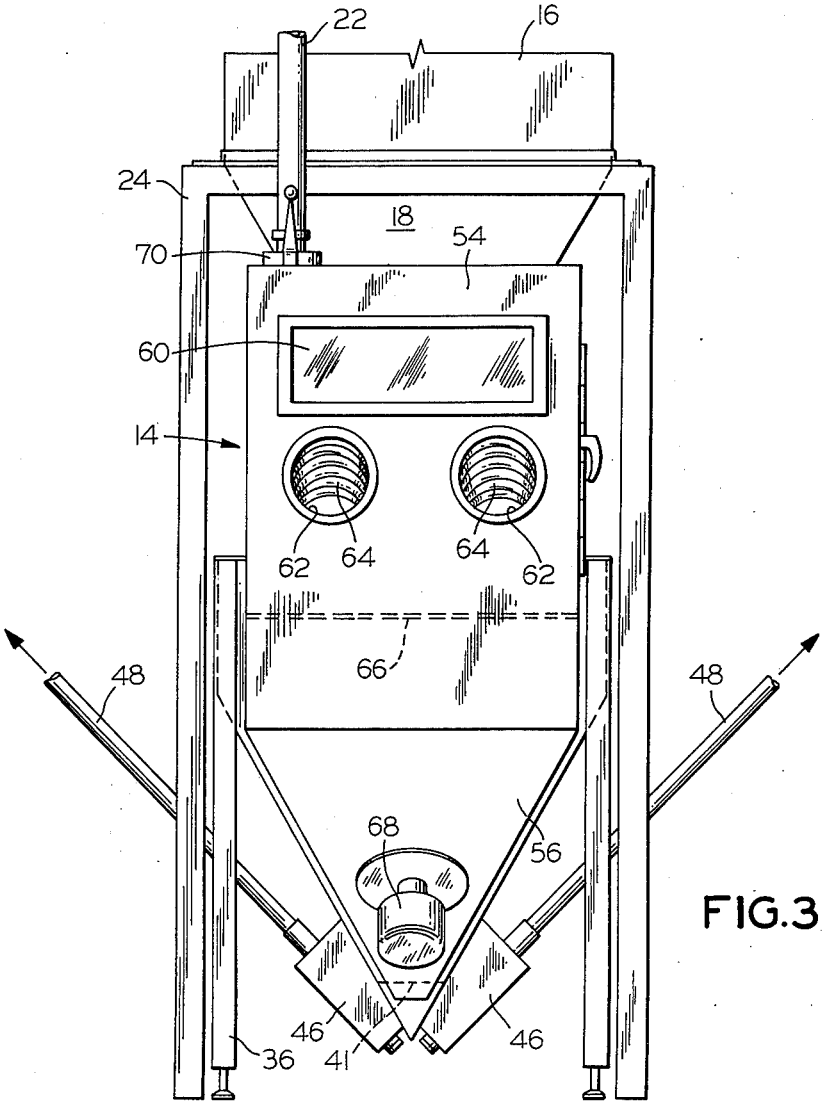
FIG. 3 is a fragmentary side elevational view of the lower portion of the system of FIG. 1.

Turning now in detail to the appended drawings, therein illustrated is a powder handling system embodying the present invention, and comprising collection, mixing and loading zones, generally designated respectively by the numerals 10, 12 and 14. The collection section 10 consists essentially of a rectangular housing 16 defining a chamber therewithin, and having a tapered outlet hopper 18 at its base, a powder inlet conduit 20 (communicating with coating apparatus, not shown), connected to one side of the housing 16, and a vacuum conduit 22 connected to the opposite side thereof. The housing 16 is supported upon a suitable stand 24; it, in turn, supports a motor 26, which mounts and drives a fan (not shown) to vacuumize the system. The housing 16 is provided with an access door 28, secured thereon by bolted bars 30, which may be removed to enable entry into the chamber therewithin for cleaning and other purposes. A pressure-responsive blow-out panel 32 is also provided, as a safety feature.

The mixing zone 12 is provided essentially by a second hopper 34, supported on a second stand 36, and disposed directly beneath the collection zone 10. The hopper 34 is divided, by a vertically positioned internal baffle 38, having a lower edge 41, into two side-by-side chambers 39, 40, with the upper hopper 18 being interconnected to the lower hopper 34 through a valve 42, so as to empty only into the chamber 40. The lower hopper 34 is also provided with an access door 44, and it has a pair of screw feeders 46 mounted at its base and adapted to remove powder from the hopper 34 for introduction into other apparatus (normally the powder coating apparatus) through the pipes 48. The valve 42 is secured between the hoppers 18, 34 with suitable clamps 50, and it is fitted with a level sensor 52.

The loading zone 14 consists essentially of a rectangular housing 54, mounted on one side of the lower hopper 34, and including a tapered outlet trough 56 communicating therewith and emptying into the chamber 39 thereof. The housing 54 is provided with a loading door 58, a viewing window 60, and two apertures 62, which are sealed with hand-receiving glove members 64 mounted therein. A expanded metal shelf 66 is disposed horizontally across the lower part of the housing 54, and a second level sensor 68 is mounted on the outlet trough 56. A valve 70, situated at the top of the housing 54, controls flow through the vacuum conduit 22.

In operation, the motor 26 propels the internal fan to create a vacuum within the chamber of the housing 16, drawing powder into the collection zone 10 from the coating apparatus, through conduit 20. When an appropriate amount of powder has accumulated, the level sensor 52 either automatically activates the valve 42 to dump the power into the chamber 40 of hopper 34, or signals the need for it to be done manually. The screw feeders 46 may then return the powder for use in the coating apparatus.

The system is designed to permit continuous replenishment of powder utilized. The level sensor 68, fitted on the outlet trough 56, indicates when the amount of virgin powder contained therewithin is becoming depleted. At that time, the normally closed valve 70 is opened, to draw a vacuum within the loading zone 14, thus permitting opening of the door 58 without causing discharge of powder from the system. A sealed container of fresh powder may then be placed upon the shelf 66. After closing the door 58 and the valve 70, the container may be opened, with access thereto being provided through the gloved apertures 62, enabling the contents to fall through the shelf 66 and flow down the trough 56 into the chamber 39, from which it can be conveyed by the feeders 46.

The function of the baffle 38 is important to note. Were it not for the vertical segregation of the virgin and reclaimed powder provided thereby, those fractions would exist as strata within the hopper 34, due to the sequence of dumping of recycled powder and introduction of fresh material into the system. Since the nature of recycled powder differs from that of the fresh product, such stratification would, in turn, lead to undesirable variations in coating characteristics. The constant blending which occurs beneath the lower edge 41 of the baffle 38 ensures a highly uniform mix of powder, and thereby the achievement of consistent results in th coating operation.

Thus, it can be seen that the present invention provides a novel, vacuum-operated powder handling system which enables the introduction of fresh powder without curtailment or cessation of normal operations. Means is provided to ensure the uniformity of the blend, and the system is of relatively simple and inexpensive construction, while being efficient in operation and convenient in use.

Having thus described the invention, what is claimed is:

1. A powder handling system comprising:

at least one enclosure defining therewithin collecting, loading and mixing chambers, said collecting and loading chambers being in gas-flow communication with one another and each being in powder-flow communication with said mixing chamber, said enclosure having an inlet for admitting airborne powder into said collecting chamber, an outlet for the withdrawal of powder from said mixing chamber, and a displaceable portion therein permitting entry into said loading chamber; valve means for controlling gas flow between said collecting and loading chambers; and means for creating a vacuum within said collecting chamber, whereby, in operation of said system, powder may be drawn into said collecting chamber and discharged from said mixing chamber, and whereby the supply thereof may be replenished during such operation by placing a fresh charge of powder within said loading chamber while said valve means is so controlled as to establish a vacuum therein.

2. The system of claim 1 wherein said enclosure comprises three housings, said collecting, loading and mixing chambers each being defined within a different one of said housings, said system additionally including a valved conduit between said collecting chamber housing and said loading chamber housing, and also including a valve interposed between said collecting chamber housing and said mixing chamber housing to control the flow of powder from said collecting chamber to said mixing chamber.

3. The system of claim 2 wherein each of said housings is of hopper-like configuration, and wherein said collecting chamber housing is disposed above said mixing chamber housing to permit the gravitational flow of powder from said collecting chamber to said mixing chamber.

4. The system of claim 3 additionally including sensors adapted to detect the amounts of powder present in each of said collecting chamber and said loading chamber.

5. The system of claim 2 wherein said loading chamber housing includes a perforated, substantially horizontally disposed platform adapted to support a fresh charge of powder placed within said housing.

6. The system of claim 5, wherein said loading chamber housing additionally includes access ports having hand-receiving flexible members disposed thereacross, to permit manipulation of a container of powder supported upon said platform while maintaining the closed condition of said housing.

7. The system of claim 1 wherein said mixing chamber contains means for vertically dividing it into two compartments, said collecting chamber communicating with a first one of said compartments and said loading chamber communicating with a second one of said compartments, both of said compartments being in communication with said enclosure outlet.

8. The system of claim 7 wherein said compartments communicate with one another at a location upstream of said enclosure outlet.

9. The system of claim 7 wherein said dividing means comprises a generally vertical partition.

10. The system of claim 9 wherein said outlet is located adjacent the lower end of said mixing chamber, and wherein said partition has a lower edge disposed above said outlet and affording communication between said compartments therebelow.

* * * * *